US009932927B2

(12) United States Patent
Ruppel et al.

(10) Patent No.: US 9,932,927 B2
(45) Date of Patent: Apr. 3, 2018

(54) CYLINDER HEAD COVER

(71) Applicant: Mahle International GmbH, Stuttgart (DE)

(72) Inventors: Stefan Ruppel, Heidelberg Emmertsgrund (DE); Leszek Goerlich, Leonberg (DE); Christoph Lohre, Renningen (DE); Jochen Friz, Welzheim (DE); Stefan Fleck, Neubulach (DE); Siegfried Deiss, Stuttgart (DE)

(73) Assignee: Mahle International GmbH (DE)

( * ) Notice: Subject to any disclaimer, the term of this patent is extended or adjusted under 35 U.S.C. 154(b) by 101 days.

(21) Appl. No.: 14/889,438

(22) PCT Filed: Apr. 29, 2014

(86) PCT No.: PCT/EP2014/058677
§ 371 (c)(1),
(2) Date: Nov. 5, 2015

(87) PCT Pub. No.: WO2014/180707
PCT Pub. Date: Nov. 13, 2014

(65) Prior Publication Data

US 2016/0076479 A1 Mar. 17, 2016

(30) Foreign Application Priority Data

May 6, 2013 (DE) ..... 10 2013 208 231

(51) Int. Cl.
*F02F 1/24* (2006.01)
*F02F 7/00* (2006.01)

(52) U.S. Cl.
CPC ..... *F02F 1/24* (2013.01); *F02F 7/006* (2013.01)

(58) Field of Classification Search
CPC ..... F02F 11/002; F02F 7/0073; F02F 1/24; F02F 2007/0063; F02B 77/00
See application file for complete search history.

(56) References Cited

U.S. PATENT DOCUMENTS 4,498,433 A * 2/1985 Ogawa ..... B29C 51/16 123/195 C
4,608,950 A * 9/1986 Payne ..... F02F 7/006 123/195 C (Continued)

FOREIGN PATENT DOCUMENTS

DE 10024164 A1 11/2001
DE 10320493 A1 12/2004

(Continued)

OTHER PUBLICATIONS

Machine Transalation of JP2006090146A.*

(Continued)

*Primary Examiner* — Long T Tran
(74) *Attorney, Agent, or Firm* — Fishman Stewart PLLC

(57) ABSTRACT

A cylinder head cover for a cylinder head of a piston engine may include a cover body for mounting on the cylinder head. The cover body may include a cover body section and a first longitudinal side edge disposed opposite a second longitudinal side edge. An outer cover seal may seal off the cover body from the cylinder head and extend completely around along an outer edge of the cover body. A securing bridge may be fitted over the cover body on an outer side along the cover body section from the first longitudinal side edge of the cover body to the second longitudinal side edge.

20 Claims, 6 Drawing Sheets

(56) References Cited

U.S. PATENT DOCUMENTS

| | | | | |
|---|---|---|---|---|
| 5,513,603 | A * | 5/1996 | Ang | F02B 77/00 123/198 E |
| 7,305,962 | B2 | 12/2007 | Nonogaki et al. | |
| 7,574,991 | B2 * | 8/2009 | Kumagai | F01L 1/053 123/195 C |
| 7,757,646 | B2 * | 7/2010 | Kumagai | F01L 1/053 123/193.5 |
| 7,814,880 | B2 * | 10/2010 | Waters | B29C 45/14467 123/195 C |
| 8,607,747 | B2 * | 12/2013 | Herrmann | F02F 7/006 123/90.1 |
| 8,646,436 | B2 * | 2/2014 | Wakabayashi | F02F 7/006 123/509 |
| 8,800,518 | B2 * | 8/2014 | Smith | F02F 7/006 123/195 C |
| 2002/0166534 | A1 | 11/2002 | Schneider et al. | |
| 2004/0031638 | A1 | 2/2004 | Kramer et al. | |
| 2007/0262486 | A1 * | 11/2007 | Waters | B29C 45/14467 264/220 |
| 2008/0173274 | A1 | 7/2008 | Inui et al. | |
| 2009/0169142 | A1 * | 7/2009 | Grass | F01L 1/047 384/428 |
| 2012/0006304 | A1 * | 1/2012 | Wakabayashi | F02F 7/006 123/509 |
| 2013/0239922 | A1 * | 9/2013 | Festag | F01M 13/0416 123/195 C |

FOREIGN PATENT DOCUMENTS

| | | |
|---|---|---|
| DE | 102005014535 A1 | 10/2005 |
| DE | 102005062546 A1 | 7/2007 |
| JP | 08086221 | 4/1996 |
| JP | 11050827 | 2/1999 |
| JP | 2006090146 | 4/2006 |

OTHER PUBLICATIONS

English abstract for JP-08086221.
Englisha abstract for DE-10320493.
English abstract for DE-102005062546.
English abstract for JP-2006090146.
English abstract for JP-11050827.

* cited by examiner

CYLINDER HEAD COVER

CROSS-REFERENCE TO RELATED APPLICATIONS

This application claims priority to German Patent Application No. 10 2013 208 231.2, filed May 6, 2013, and International Patent Application No. PCT/EP2014/058677, filed Apr. 29, 2014, both of which are hereby incorporated by reference in their entirety.

TECHNICAL FIELD

The present invention relates to a cylinder head cover for a cylinder head of a piston engine. The invention also relates to a piston engine equipped with such a cylinder head cover.

BACKGROUND

A piston engine usually consists of an engine block, in which cylinders are formed, in which pistons of the piston engine are arranged in a stroke-adjustable manner. Underneath the engine block, a crankcase is generally adjoined, in which a crankshaft is rotatably mounted, which is drive-connected to the pistons via connecting rods. An oil sump is generally adjoined to the bottom of the crankcase. A cylinder head is generally adjoined to the top of the engine block and covers the individual cylinders at the top and contains inlet and outlet ducts that communicate with the cylinders. Charge exchange valves are usually arranged on the cylinder head. Camshafts are also usually mounted on the cylinder head to actuate the charge exchange valves. A cylinder head cover is adjoined to the top of the cylinder head, said cylinder head cover covering the cylinder head and the components arranged thereon. Fuel injectors can be attached to the cylinder head cover, which fuel injectors can inject fuel into the cylinders through the cylinder head cover and through the cylinder head.

Such a cylinder head cover is expediently provided with a certain pressure stability, for example in order to be able to safely absorb an increased internal pressure that can arise in an inner space enclosed between the cylinder head cover and the cylinder head, for example as a result of "blow-by gas". Blow-by gas is produced during operation of the piston engine when leaks can enter the crankcase from the respective cylinder past piston seals during the explosions inside the combustion chambers and increase the pressure in the crankcase. The crankcase is usually fluidically connected to the above-mentioned inner space through the engine block and through the cylinder head, so the pressure can increase in said inner space too. Furthermore, a certain stability can be necessary for a cylinder head cover if additional parts are to be mounted on the cylinder head cover, such as fuel injectors or a fuel pump or the like.

It is known from DE 10 2005 062 546 A1 to produce a cylinder head cover in composite form, a skeleton assuming the load-bearing function and said skeleton being enclosed by a shell structure. The skeleton can be produced from a high-strength plastic, in particular a fibreglass-reinforced polyamide. In contrast to this, the shell structure can be produced from a simple, inexpensive plastic. The problem with such a composite design is the material mixture that arises as a result, which makes it more difficult to recycle the cylinder head cover. In particular, the different plastics must first be separated in order then to be able to recycle them.

SUMMARY

The present invention is concerned with the problem of specifying an improved embodiment for a cylinder head cover and for a piston engine equipped therewith, which in particular has a high level of stability of the cylinder head cover, so that the cylinder head cover is particularly suitable for the attachment of further components. Furthermore, subsequent recycling of the cylinder head cover should at the same time be made easier. It should also be simple to produce.

This problem is solved according to the invention by the subject matter of the independent claim(s). Advantageous embodiments form the subject matter of the dependent claims.

The invention is based on the general concept of equipping the cylinder head cover with a cover body and with a separate securing bridge, both the cover body and the securing bridge each being provided for mounting on the cylinder head. The cover body is equipped with an outer cover seal for sealing off the cover body from the cylinder head, said outer cover seal completely running around along an outer edge of the cover body. This means that a sealing function of the cylinder head cover is assumed exclusively by the cover body in conjunction with the outer cover seal, so that the securing bridge makes no contribution to the sealing off of the inner space enclosed between the cylinder head and the cylinder head cover or cover body in the mounted state. The securing bridge, which for its part can be fastened to the cylinder head separately from the cover body, can be optimised for additional functions, for example, to be able to attach additional components to the cylinder head cover. To be able to support the securing bridge stably and securely on the cylinder head, the securing bridge fits over the cover body on an outer side along a cover body section from a first longitudinal side edge of the cover body to an opposite second longitudinal side edge of the cover body. Since the securing bridge thus fits over or bridges the cover body in the respective cover body section, forces acting on the securing bridge can be transmitted directly to the cylinder head without the cover body being loaded.

An inner side of the securing bridge that faces the cover body is expediently shaped in a complementary manner to the outer side of the cover body in the cover body section in such a manner that the securing bridge is in contact with the cover body in the cover body section. As a result, the cover body can at the same time be supported outwardly on the securing bridge. A pressure stability of the cover body for example can be improved thereby. According to another advantageous embodiment, it can be provided for the securing bridge to press the cover body in the cover body section against the cylinder head when in the mounted state. A certain prestress for the cover body can thereby be realised with the aid of the securing bridge, which in particular improves the pressure stability of the cover body.

The cover body can expediently be produced uniformly from one plastic material. In particular, the cover body can be injection-moulded from plastic in one piece. The securing bridge can likewise be produced from a plastic, in this case however a composite material also being considered, to provide the securing bridge with greater strength. For example, a fibre-reinforced plastic can be used to produce the securing bridge. Alternatively, the securing bridge can also be designed as a metal component. In particular, the securing bridge is a single-piece injection-moulded part. Recycling of the cylinder head cover is made easier, because the cylinder head and the securing bridge form separate parts and are each formed in a materially uniform manner.

It is of particular significance that the securing bridge represents a separate part from the cover body, so these parts can be separated easily from each other for recycling. In particular, there is no permanent connection between the cover body and the securing bridge.

The outer cover seal is expediently designed as an axial seal, which therefore bears in a sealing manner against the cover body and the cylinder head in the direction in which the cover body is also fastened to the cylinder head.

The securing bridge is expediently formed in such a manner that it is connected to the cylinder head outside the outer cover seal when in the mounted state. In other words, the outer cover seal runs inside the securing bridge in the cover body section.

According to an advantageous embodiment, the cover body can have a cover opening in the cover body section, while the securing bridge has a pump console for mounting a fuel pump. Said pump console can then have a bridge opening inside the cover opening, which bridge opening passes through the securing bridge and through which a pump drive for driving the fuel pump can interact with a drive cam of a camshaft of the cylinder head, which is covered by the cover body, when the cylinder head cover is in the mounted state. In this case, the securing bridge is thus used to mount a fuel pump, which is drive-coupled to a camshaft of the cylinder head during operation. In such a drive, relatively large drive forces are transmitted, which must ultimately be absorbed by the pump console. Since the pump console is situated on the securing bridge and the latter is supported on the cylinder head independently of the cover body, said large drive forces do not act on the cover body.

According to an advantageous development, a bridge seal can be provided to seal off the cover body from the securing bridge, said bridge seal running around in a closed manner along an inner edge, which encloses the cover opening, of the cover body. The sealing function of the cover body can thereby also be ensured in the region of the cover opening. The bridge seal is expediently also designed as an axial seal, so that it bears in a sealing manner against the cover body and against the securing bridge in the direction in which the securing bridge is placed onto the cover body.

The pump console can have a duct, which surrounds the bridge opening and which passes through the cover opening into the inner space enclosed between the cover body and the cylinder head. The drive connection between the drive cam and the fuel pump is made through this duct. The bridge opening is expediently provided with a round, in particular circular cross section, which makes production of the pump console and thus of the securing bridge simpler. In contrast, the cover opening is expediently provided with an angular, in particular rectangular opening cross section, which can also be stepped in longitudinal section. If the securing bridge bridges or fits over the cover body in an arc-like manner, a sealing direction that is oriented in an inclined manner to the mounting direction can result in the region of the cover opening, which can be problematic. The angular and/or stepped shape of the cover opening means that the bridge seal can be laid particularly simply such that contacting of the bridge seal takes place through the securing bridge and cover body largely parallel to the mounting direction.

In another advantageous embodiment, the securing bridge can have bridge fastening points, which allow direct contact and direct connection to the cylinder head outside the outer edge of the securing body. The securing body can thus be fixed to the cylinder head completely independently of the cover body. In this manner, all forces that act on the securing bridge can be transmitted to the cylinder head without interaction with the cover body.

In another embodiment, the cover body can have at least one positioning element, which interacts in a form-fitting manner with a counter positioning element, which is complementary thereto and is formed on the securing bridge, to position the securing bridge relative to the cover body. This measure simplifies mounting of the cylinder head cover.

According to a further advantageous embodiment, the cover body can have at least one injector mounting point for attaching a fuel injector, at least in the cover body section. The securing bridge can then have an injector cut-out for the respective injector mounting point, through which cut-out the respective injector mounting point for attaching the respective fuel injector is accessible. In this manner, the attachment of fuel injectors is not impaired by the presence of the securing bridge, which makes the mounting of the cylinder head cover on the cylinder head simpler. In particular, the respective injector mounting point can be completely enclosed by the securing bridge, that is, such that it runs around in a closed manner.

In another advantageous embodiment, the securing bridge can have two longitudinal webs, which extend along the two longitudinal side edges of the cover body, the securing bridge having at least two transverse webs, which extend from one longitudinal web via the cover body section to the other longitudinal web. The securing bridge obtains a comparatively stable structure thereby. While the longitudinal webs expediently extend in a straight line, the transverse webs can preferably extend in an arc-shaped manner, in particular in such a manner that they are concave on the inner side facing the cover body. This arc shape allows for example pressure forces acting on the securing bridge from the outside to be transmitted in a particularly favourable manner from the transverse webs to the longitudinal webs and from the latter to the cylinder head. If three or more transverse webs are present, at least one transverse web can extend between two adjacent injector mounting points of the above-mentioned type.

In another embodiment, the securing bridge can be supported on the cover body section by means of at least one elastomer body. For example, vibrations can be damped with the aid of such an elastomer body. Also, such an elastomer body can be used to realise a certain prestress between the securing bridge and the cover body. Finally, the elastomer body can be used to compensate a play that can arise for example owing to production tolerances between the cover body and the securing bridge. At least one such elastomer body can be arranged substantially centrally. For example, such an elastomer body can be positioned on one of the transverse webs, for instance centrally between the two longitudinal webs.

In a preferred embodiment, such an elastomer body can be ring-shaped. In particular, the ring-shaped elastomer body can have an H-shaped cross-sectional profile in the circumferential direction thereof.

In another advantageous embodiment, the securing bridge can have an engine bearing point for supporting an engine bearing. Engine bearings are used to be able to support oscillations and vibrations of the piston engine on a frame structure of the vehicle equipped therewith. Thanks to the proposal according to the invention, it is now possible to arrange such an engine bearing on the cylinder head cover, so the piston engine can also be supported on the frame structure in the region of the cylinder head cover. For example, such an engine bearing can be realised by means of an engine bearing strut, a first end of which is supported on the engine bearing point of the securing bridge and a second end of which is supported on said frame structure of the vehicle. Said engine bearing strut can have at its first end and/or at its second end an elastomer bearing, in order to be able to achieve the desired elastic support for the piston engine on the frame structure.

According to another advantageous embodiment, the securing bridge can have at least one securing bolt for fastening an attachment part. For example, it can be desirable to conceal the piston engine with the aid of a decorative cover. Such a decorative cover can be fastened to the securing bridge by means of such a securing bolt. The cylinder head cover thus has a further additional function to the attachment of additional components.

According to another advantageous embodiment, the securing body can have a blow-by gas outlet outside the securing bridge, through which outlet blow-by gas can be discharged out of the inner space enclosed between cylinder head cover and cylinder head, for example in order to supply the blow-by gas to a fresh air tract of the piston engine. The blow-by gas generally entrains oil, which should remain in the piston engine. To this end, an oil separation device is usually arranged in a blow-by gas return line, so that only de-oiled blow-by gas is ultimately supplied to the fresh air tract, while the separated oil is fed back to the piston engine or remains in the piston engine. Particularly expedient is an embodiment in which such an oil separation device is arranged on an inner side of the cover body that faces the cylinder head, for example in the form of a cyclone separator or labyrinth separator or impactor.

According to a preferred embodiment, it can be provided for the securing bridge to press the cover body against the cylinder head in the region of the first longitudinal side edge and/or in the region of the second longitudinal side edge when the cylinder head cover is in the mounted state. The securing bridge thus supports the fixing and sealing off of the cover body on the cylinder head. Other separate fastening points of the cover body can thereby be relieved and in particular at least some of them can be omitted in the region of the securing bridge. According to an advantageous development, the securing bridge can form a shoulder in the region of the respective longitudinal side edge, which shoulder acts as a holding-down device and in particular makes direct contact with a complementary step formed on the cover body.

In another embodiment, it can be provided for the securing bridge to be adhesively bonded to the cover body. In this manner, an easy-to-handle unit of cover body and securing bridge can be formed, which makes mounting easier.

A piston engine according to the invention has in the usual manner a cylinder head, to which a cylinder head cover of the above-described type is attached.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

BRIEF DESCRIPTION OF THE DRAWINGS

Preferred exemplary embodiments of the invention are shown in the drawings and are explained in more detail in the description below, the same reference symbols referring to the same or similar or functionally equivalent components.

In the figures.

DETAILED DESCRIPTION

Figure 1:
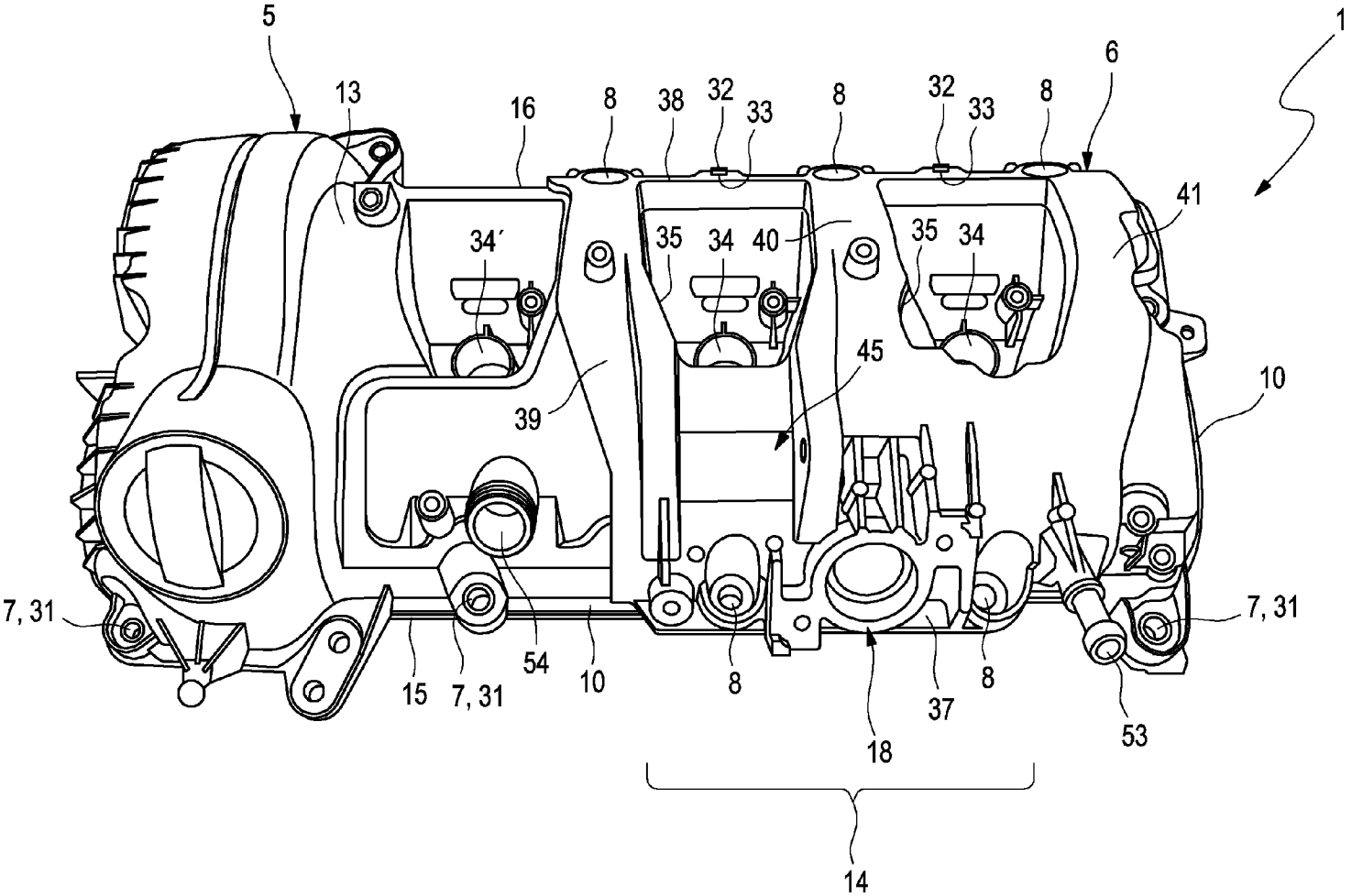
FIG. 1 schematically shows an isometric plan view of a cylinder head cover.

According to FIGS. 1 to 6, a cylinder head cover 1, which is provided for mounting on a cylinder head 2 (only indicated in FIGS. 3, 4 and 6) of a piston engine 3, in particular of a motor vehicle 4 (only indicated in FIG. 6), comprises a cover body 5 and a securing bridge 6. The cover body 5 is provided for mounting on the cylinder head 2. The securing bridge 6 forms a separate part from the cover body 5 and is likewise provided for mounting on the cylinder head 2. The cover body 5 is provided for mounting on the cylinder head 2 independently of the securing bridge 6. To this end, the cover body 5 has fastening points 7 on the cover body side, which allow separate fastening of the cover body 5 to the cylinder head 2. The securing bridge 6 however has fastening points 8 on the securing bridge side, which are independent of the fastening points 7 of the cover body 5 and allow separate fixing of the securing bridge 6 to the cylinder head 2.

The cover body 5 is equipped with an outer cover seal 9, which seals off the cover body 5 from the cylinder head 2 when in the mounted state. The outer cover seal 9 runs around completely along an outer edge 10 of the cover body 5, so that the cover body 5 in conjunction with the outer cover seal 9 can seal off an inner space 11, which is enclosed between the cover body 5 and the cylinder head 2 and can be seen in FIGS. 3 and 4, from an environment 12 of the piston engine 3 when in the mounted state.

The securing bridge 6 is arranged on the cover body 5 such that said bridge fits over the cover body 5 on an outer side 13 facing away from the cylinder head 2 along a cover body section 14 in such a manner that the securing bridge 6 extends from a first longitudinal side edge 15 to an opposite second longitudinal side edge 16.

The securing bridge 6 is fastened to the cylinder head 2 outside the outer cover seal 9 when in the mounted state. The outer cover seal 9 thus also runs inside the securing bridge 6 in the cover body section 14.

Figure 2:
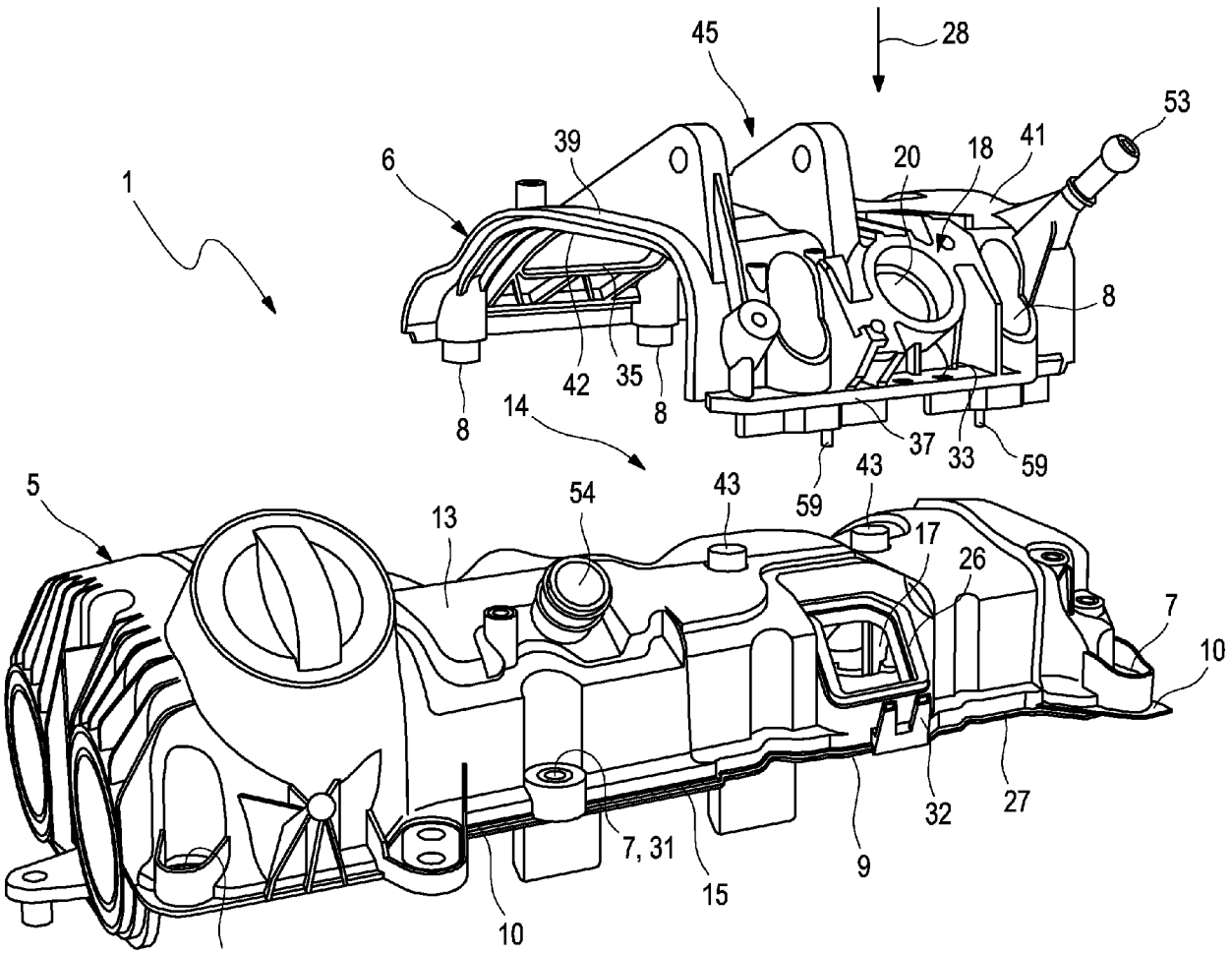
FIG. 2 schematically shows an isometric, exploded view of the cylinder head cover, FIG. 3 schematically shows a cross section of the cylinder head cover in the region of an elastomer body, FIG. 4 schematically shows a cross section of the cylinder head cover in the region of a fuel pump, FIG. 5 schematically shows an isometric view of the cylinder head cover with the fuel pump attached thereto and the engine bearing attached thereto, FIG. 6 schematically shows an isometric view of the cylinder head cover in a mounted state.
Figure 4:
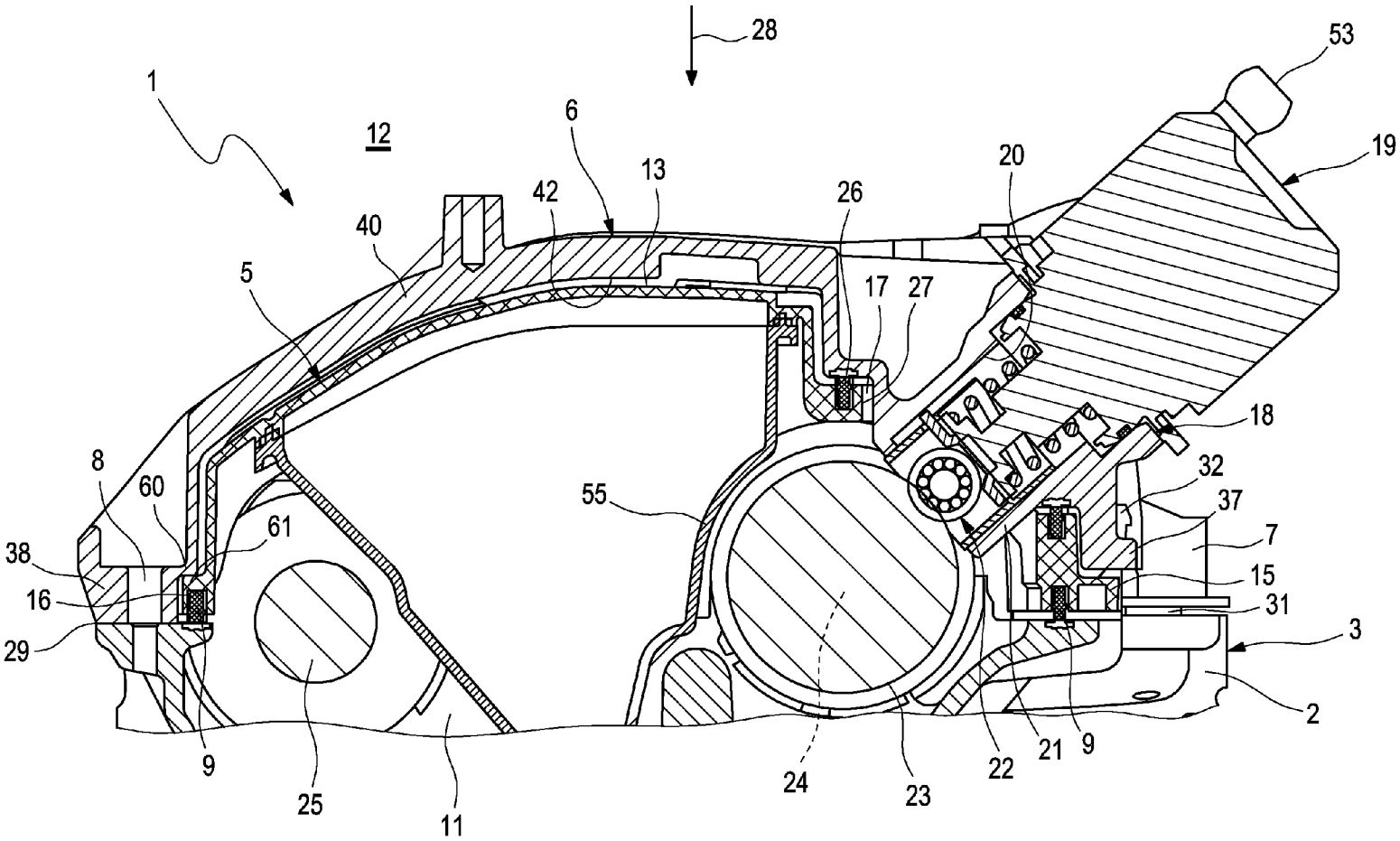

According to FIGS. 2 and 4, the cover body 5 expediently has a cover opening 17 in the cover body section 14, while the securing bridge 6 has a pump console 18 in the region of said cover opening 17, with the aid of which pump console a fuel pump 19 can be fastened to the securing bridge 6 and thus to the cylinder head cover 1. The pump console 18 then has a bridge opening 20, which passes through the securing bridge 6, inside the cover opening 17. For example, the pump console 18 can to this end have a duct 21, which encloses the bridge opening 20 in a circumferential direction, for example cylindrically. In the mounted state according to FIG. 4, a pump drive 22, which is provided to drive the fuel pump 19, can then interact through the bridge opening 20 or through the duct 21 with a drive cam 23 of a camshaft 24, which is covered by the cylinder head cover 1 or by the cover body 5. The camshaft 24 is mounted on the cylinder head 2. In FIG. 4, a further camshaft 25 can be seen, which is likewise mounted on the cylinder head 2 and is covered by the cover body 5. The pump drive 22 can for example be configured in the manner of a roller tappet, the stroke of which is actuated by means of the drive cam 23, as a result of which a linear force transmission takes place in the stroke direction between the camshaft 24 and the fuel pump 19. The forces acting on the fuel pump 19 are transmitted to the pump console 19 and supported by the latter on the cylinder head 2 by means of the securing bridge 6.

In order to be able to seal off the cover body 5 from the securing bridge 6 in the region of the cover opening 17, a bridge seal 26 is expediently provided, which runs around in a closed manner along an inner edge 27, which encloses the cover opening 17, of the cover body 5. The cover opening 17 is provided here with a rectangular opening cross section, which is also stepped in the cross section of the cylinder head cover 1 according to FIG. 4. The bridge seal 26 follows the profile of the inner edge 27 in such a manner that contact is made in each case between the securing bridge 6 and the bridge seal 26 on one side and between the cover body 5 and the bridge seal 26 on the other side parallel to a mounting direction 28 in which the cover body 5 and the securing bridge 6 are mounted on the cylinder head 2.

As can be seen in particular in FIG. 4, the fastening points 8 on the securing bridge side, which are also referred to below as bridge fastening points 8, allow direct contact 29 and thus direct fixing to the cylinder head 2 outside the outer edge 10 of the cover body 5. For example, the securing bridge 6 is screw-fastened tightly to the cylinder head 2. In contrast to this, it can be provided in the fastening points 7 on the cover body side, which are also referred to below as cover fastening points 7, for a spacing 30, which can be seen for example in FIG. 3, to remain between the cover body 5 and the cylinder block 2, said spacing being bridged by the compressed outer cover seal 9. The cover fastening points 7 are expediently stiffened with sleeves 31, which can project over the cover body 5 on an inner side of the cover body 5 that faces the cylinder head 2 and can be screw-fastened tightly to the cylinder head 2 according to FIGS. 3 and 4. Whereas the cylinder head cover 5 is preferably produced from plastic, the sleeves 31 are preferably produced from metal. The securing bridge 6 is itself preferably produced from metal, so no such sleeves 31 are necessary in the region of the bridge fastening points 8.

According to a preferred embodiment, it can be provided according to FIG. 4 for the securing bridge 6 to press the cover body 5 against the cylinder head 2 in the region of the first longitudinal side edge 15 and/or in the region of the second longitudinal side edge 16 when the cylinder head cover 1 is in the mounted state. The securing bridge 6 thereby supports the fixing and sealing off of the cover body 5 on the cylinder head 2. In particular separate screw fastenings of the cover body 5 to the cylinder 2 can then be omitted in these regions. FIG. 4 (left) shows purely by way of example how the securing bridge 6 presses the cover body 5 against the cylinder head 2 in the region of the second longitudinal side edge 16. To this end, the securing bridge 6 can form or have a shoulder 60 in the region of the respective longitudinal side edge 16, which shoulder acts as a holding-down device and makes direct contact with a complementary step 61 formed on the cover body 5.

According to FIGS. 1 and 2, the cover body 5 can have a plurality of positioning elements 32, which interact with complementary counter positioning elements 33 formed on the securing bridge 6 in order to position the securing bridge 6 in a form-fitting manner relative to the cover body 5.

According to FIG. 1, the cover body 5 has a plurality of injector mounting points 34, of which at least one is arranged in the cover body section 14. In the example shown here, a total of three injector mounting points 34 is provided, of which two are arranged in the cover body section 14. The third injector mounting point 34 however is arranged outside the cover body section 14 and is referred to below with 34'. The securing bridge 6 has one injector cut-out 35 for each of the injector mounting points 34 arranged in the cover body section 14, which cut-out is dimensioned such that the respective injector mounting point 34 is accessible through the respective injector cut-out 35 in such a manner that the associated fuel injector can be mounted on the cover body 5. The respective injector cut-out 35 is then completely enclosed by the securing bridge 6.

The securing bridge 6 here has two longitudinal webs 37, 38 and a plurality of transverse webs 39, 40, 41. The two longitudinal webs 37, 38 each extend along one of the two longitudinal side edges 15, 16 of the cover body 5. The three transverse webs 39, 40, 41 provided here extend from one longitudinal web 37 via the cover body section 14 to the other longitudinal web 38. Whereas the two longitudinal webs 37, 38 run substantially in a straight line, the three transverse webs 39, 40, 41 extend in an arc-shaped manner. The left-hand transverse web 39 and the central transverse web 40 each extend between two adjacent injector mounting points 34, 34'.

The inner side 42 of the securing bridge 6 that faces the cover body 5 can be in direct contact with the outer side 13 of the cover body 5. In particular, the securing bridge 6 can press the cover body 5 against the cylinder head 2 when in the mounted state. However, the embodiment shown, in which the securing bridge 6 is supported on the cover body section 14 by means of at least one elastomer body 43, is preferred. Two such elastomer bodies 43 are shown here. These can expediently have a ring-shaped structure. According to FIG. 3, the respective ring-shaped elastomer body 43 can have an H-shaped profile 44 in the circumferential direction. The elastomer bodies 43 are arranged substantially centrally between the securing bridge 6 and the cover body section 14. In particular, direct contact between the securing bridge 6 and the cover body 5 is avoided according to an advantageous embodiment. In this case, the securing bridge 6 is used only to a limited extent to increase the pressure resistance of the cover body 5.

Figure 5:
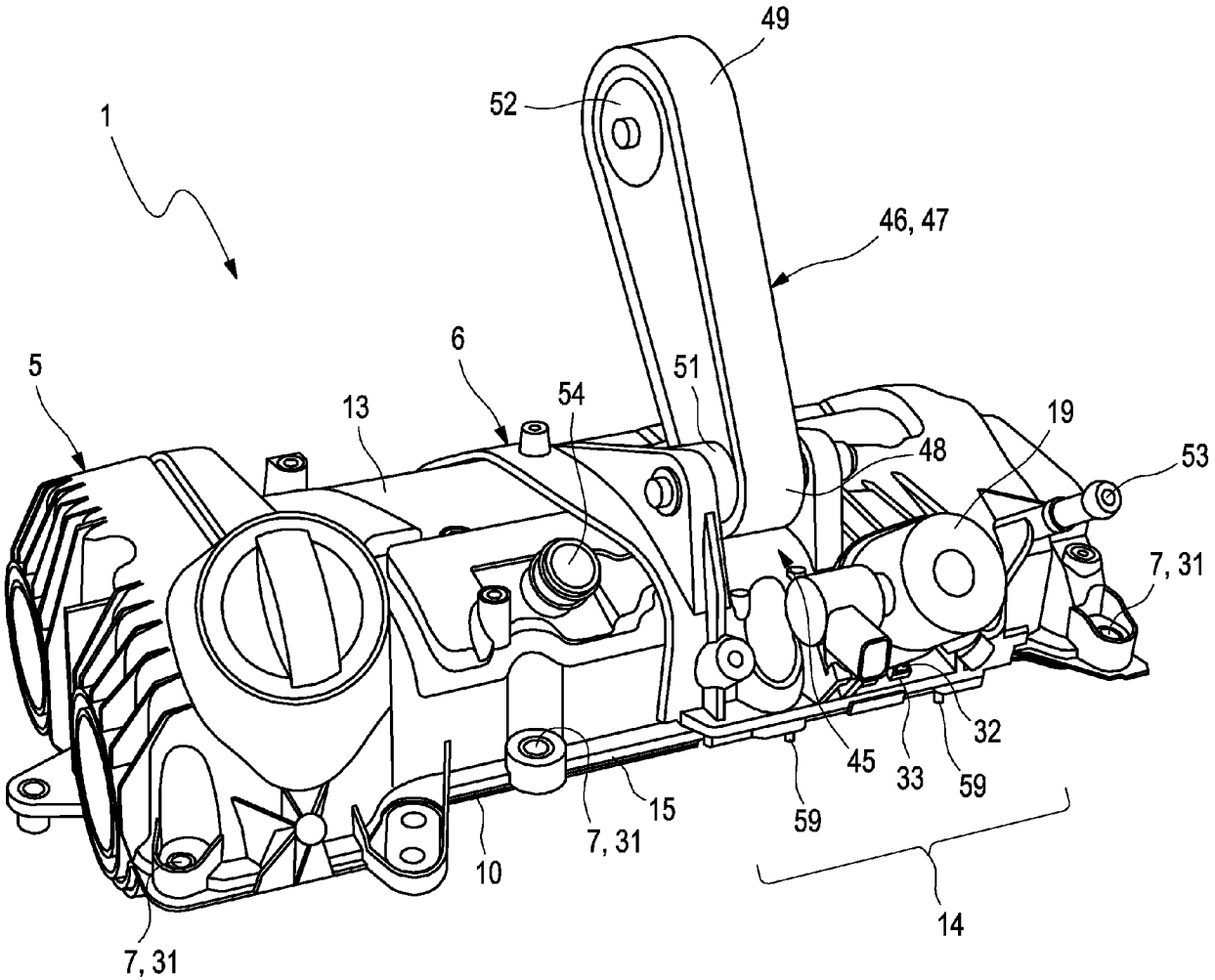
Figure 6:
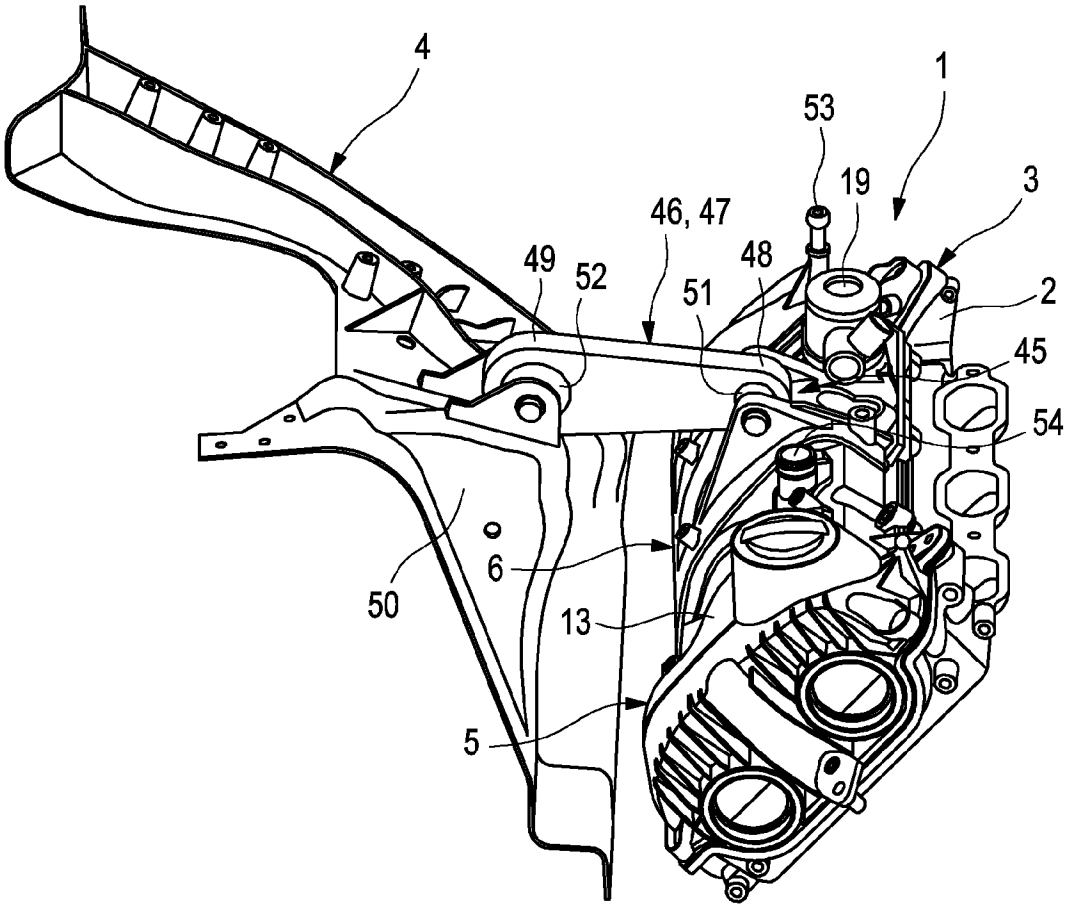

In the embodiment shown here, an engine bearing point 45 is formed on the securing bridge 6, with the aid of which engine bearing point an engine bearing 46, which can be seen in FIGS. 5 and 6, can be supported on the securing bridge 6 and thus on the cylinder head cover 1. In the example shown here, the engine bearing 46 is formed with the aid of an engine bearing strut 47, which is supported at a first end 48 on the engine bearing point 45 of the securing bridge 6 and is supported at a second end 49 on a frame structure 50 of the vehicle 4 according to FIG. 6. To this end, the engine bearing strut 47 in the example shown has one elastomer bearing 51 and 52 respectively at its first end 48 and at its second end 49.

In the embodiments shown here, the securing bridge 6 also has a securing bolt 53, with the aid of which an attachment part (not shown here) can be fastened to the securing bridge 6 and thus to the cylinder head cover 1. Such an attachment part is for example a decorative cover of the piston engine 3.

The cylinder head cover 1 shown here has a blow-by gas outlet 54 on the cover body 5 outside the securing bridge 6, to which outlet a return line can be connected to feed blow-by gas back to a fresh air system of the piston engine 3. According to the views of FIGS. 3 and 4, the cover body 5 can have further attachment parts 36, 55 on its inner side 42 that faces the cylinder head 2, which attachment parts can fulfill different functions. For example, one attachment part 36 can be an oil separation device, which is situated upstream of the blow-by gas outlet 54 in order to be able to separate oil out of the blow-by gas. The other attachment part 55 can be e.g. a spray protection or oil-conducting element, for example in order to collect lubricating oil that is sprayed by the camshafts 24, 25 owing to the prevailing centrifugal forces and to discharge it in the direction of an oil sump.

Figure 3:
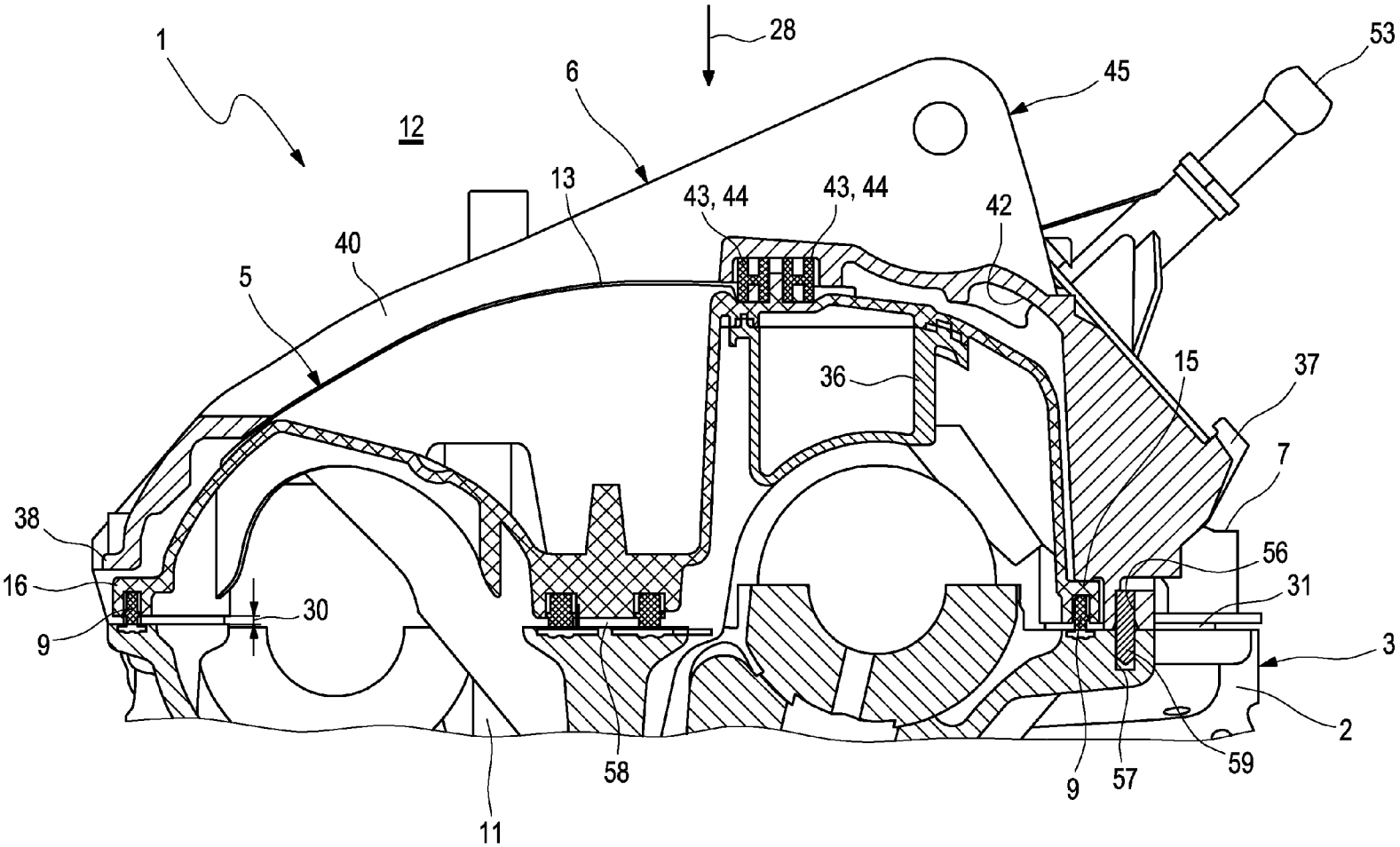

In FIG. 3, an inner cover seal 58 can also be seen, with the aid of which the cover body 5 is sealed off from the cylinder head cover 2 inside its outer edge 10. The outer cover seal 9 and the inner cover seal 58 can expediently be formed integrally on each other and thus be represented by a single seal body.

In FIGS. 2 and 3, dowel pins 59 can also be seen, with the aid of which direct positioning of the securing bridge 6 on the cylinder head 2 can be realised. Accordingly, the dowel pins 59 interact on one side with a dowel opening 56 on the securing bridge side and on the other side with a dowel opening 57 on the cylinder head side.

In another embodiment, it can be provided for the securing bridge 6 to be adhesively bonded to the cover body 5. In this manner, an easy-to-handle unit of cover body 5 and securing bridge 6 can be formed, which makes mounting easier.

The invention claimed is:

1. A cylinder head cover for a cylinder head of a piston engine, comprising:

a cover body for mounting on the cylinder head;

an outer cover seal for sealing off the cover body from the cylinder head, the outer cover seal extending completely around along an outer edge of the cover body;

a securing bridge for mounting on the cylinder head, the securing bridge fitting over the cover body on an outer side along a cover body section from a first longitudinal side edge of the cover body to an opposite second longitudinal side edge;

the cover body having a cover opening disposed in the cover body section;

the securing bridge including a pump console for mounting a fuel pump; and wherein the pump console has a bridge opening inside the cover opening and passing through the securing bridge, the bridge opening configured to receive a pump drive that interacts with a drive cam of a camshaft covered by the cover body.

2. The cylinder head cover according to claim 1, further comprising a bridge seal to seal off the cover body from the securing bridge, wherein the bridge seal extends completely around along an inner edge enclosing the cover opening of the cover body.

3. The cylinder head cover according to claim 1, wherein the securing bridge includes a plurality of bridge fastening points, the plurality of bridge fastening points allowing a direct contact and a direct connection of the securing bridge to the cylinder head outside the outer edge of the cover body.

4. The cylinder head cover according to claim 1, wherein the cover body includes at least one positioning element, the at least one positioning element interacting in a form-fitting relationship with a counter positioning element disposed complementary to the at least one positioning element on the securing bridge to position the securing bridge relative to the cover body.

5. The cylinder head cover according to claim 1, wherein the cover body includes at least one injector mounting point for attaching a fuel injector at least in the cover body section, and the securing bridge includes an injector cut-out for the at least one injector mounting point, and wherein the injector cut-out is configured to receive the fuel injector for mounting on the at least one injector mounting point.

6. The cylinder head cover according to claim 1, wherein the securing bridge includes at least two longitudinal webs each extending along one of the two longitudinal side edges of the cover body, and the securing bridge further includes at least two transverse webs each extending from one of the longitudinal webs via the cover body section to another of the longitudinal webs.

7. The cylinder head cover according to claim 1, wherein the securing bridge is supported on the cover body section via at least one elastomer body.

8. The cylinder head cover according to claim 1, wherein the securing bridge includes an engine bearing point for supporting an engine bearing.

9. The cylinder head cover according to claim 1, wherein the securing bridge has a securing bolt for fastening an attachment part.

10. The cylinder head cover according to claim 1, wherein the cover body includes a blow-by gas outlet disposed outside of the securing bridge.

11. The cylinder head cover according to claim 1, wherein the securing bridge presses the cover body against the cylinder head at least one of in a region of the first longitudinal side edge and in a region of the second longitudinal side edge when the cylinder head cover is mounted on the cylinder head.

12. The cylinder head cover according to claim 1, wherein the securing bridge is adhesively bonded to the cover body.

13. The cylinder head cover according to claim 1, wherein the pump console includes a duct disposed inside the cover opening of the cover body, the duct enclosing the bridge opening in a circumferential direction.

14. A piston engine of a motor vehicle, comprising:

a cylinder head;

a cylinder head cover mounted on the cylinder head, the cylinder head cover including:

a cover body mounted on the cylinder head, the cover body including a cover body section, a first longitudinal side edge disposed opposite of a second longitudinal side edge, and at least one injector mounting point for attaching a fuel injector at least in the cover body section;

an outer cover seal sealing off the cover body from the cylinder head, the outer cover seal extending completely around along an outer edge of the cover body;

a securing bridge disposed on an outer side of the cover body section between the first longitudinal side edge and the second longitudinal side edge; and wherein the securing bridge includes at least one injector cut-out for the at least one injector mounting point, the at least one injector cut-out configured to receive the fuel injector for mounting on the at least one injector mounting point.

15. The piston engine according to claim 14, wherein the securing bridge further includes a plurality of bridge fastening points, the plurality of bridge fastening points facilitating a direct contact and a direct connection of the securing bridge to the cylinder head outside of the outer edge of the cover body.

16. The piston engine according to claim 14, wherein the cover body further includes a positioning element and the securing bridge further includes a counter positioning element, and wherein the positioning element interacts with the counter positioning element in a form-fitting relationship to position the securing bridge relative to the cover body.

17. The piston engine according to claim 14, wherein the securing bridge is supported on the cover body section via at least one elastomer body.

18. The piston engine according to claim 14, wherein the cover body further includes a blow-by gas outlet disposed outside of the securing bridge.

19. The piston engine according to claim 14, wherein the securing bridge is adhesively bonded to the cover body.

20. A cylinder head cover for a cylinder head of a piston engine, comprising:

a cover body for mounting on the cylinder head;

an outer cover seal for sealing off the cover body from the cylinder head, the outer cover seal extending completely around along an outer edge of the cover body;

a securing bridge for mounting on the cylinder head, the securing bridge fitting over the cover body on an outer side along a cover body section from a first longitudinal side edge of the cover body to an opposite second longitudinal side edge; and wherein the securing bridge includes an engine bearing point for supporting an engine bearing.

* * * * *